US006213465B1

(12) United States Patent
Jacoby

(10) Patent No.: US 6,213,465 B1
(45) Date of Patent: Apr. 10, 2001

(54) ENTERTAINMENT KIT

(76) Inventor: Joseph Jacoby, 240 Central Park S., New York, NY (US) 10019

( * ) Notice: Subject to any disclaimer, the term of this patent is extended or adjusted under 35 U.S.C. 154(b) by 0 days.

(21) Appl. No.: 09/443,815

(22) Filed: Nov. 19, 1999

(51) Int. Cl.[7] ..... D63F 9/10
(52) U.S. Cl. ..... 273/157 R; 434/406
(58) Field of Search ..... 273/157 R, 153 R, 273/156; 434/406

(56) References Cited

U.S. PATENT DOCUMENTS 1,570,906 * 1/1926 McCord ..... 273/157 R
2,450,127 * 9/1948 Gardener et al. ..... 273/157 R
3,010,723 * 11/1961 Moss ..... 273/157 R
3,433,485 * 3/1969 Renn et al. ..... 273/157 R
4,828,497 * 5/1989 Kurgan ..... 273/157 R

* cited by examiner

*Primary Examiner*—Steven Wong
(74) *Attorney, Agent, or Firm*—Schweitzer Cornman Gross & Bondell LLP

(57) ABSTRACT

An entertainment kit including a colored jigsaw puzzle which consists of a colored drawing mounted on a first substrate which is cut into jigsaw puzzle pieces. The kit also includes an uncolored jigsaw puzzle which is a line drawing mounted on a second substrate which is cut into jigsaw puzzle pieces. The line drawing corresponds to the colored drawing except for the absence of color and is adapted to be manually colored by the user. Preferably, coloring instruments such as crayons or the like are included in the kit, along with an audio and/or visual recording. The latter contains subject matter related to the jigsaw puzzle drawings.

6 Claims, 1 Drawing Sheet

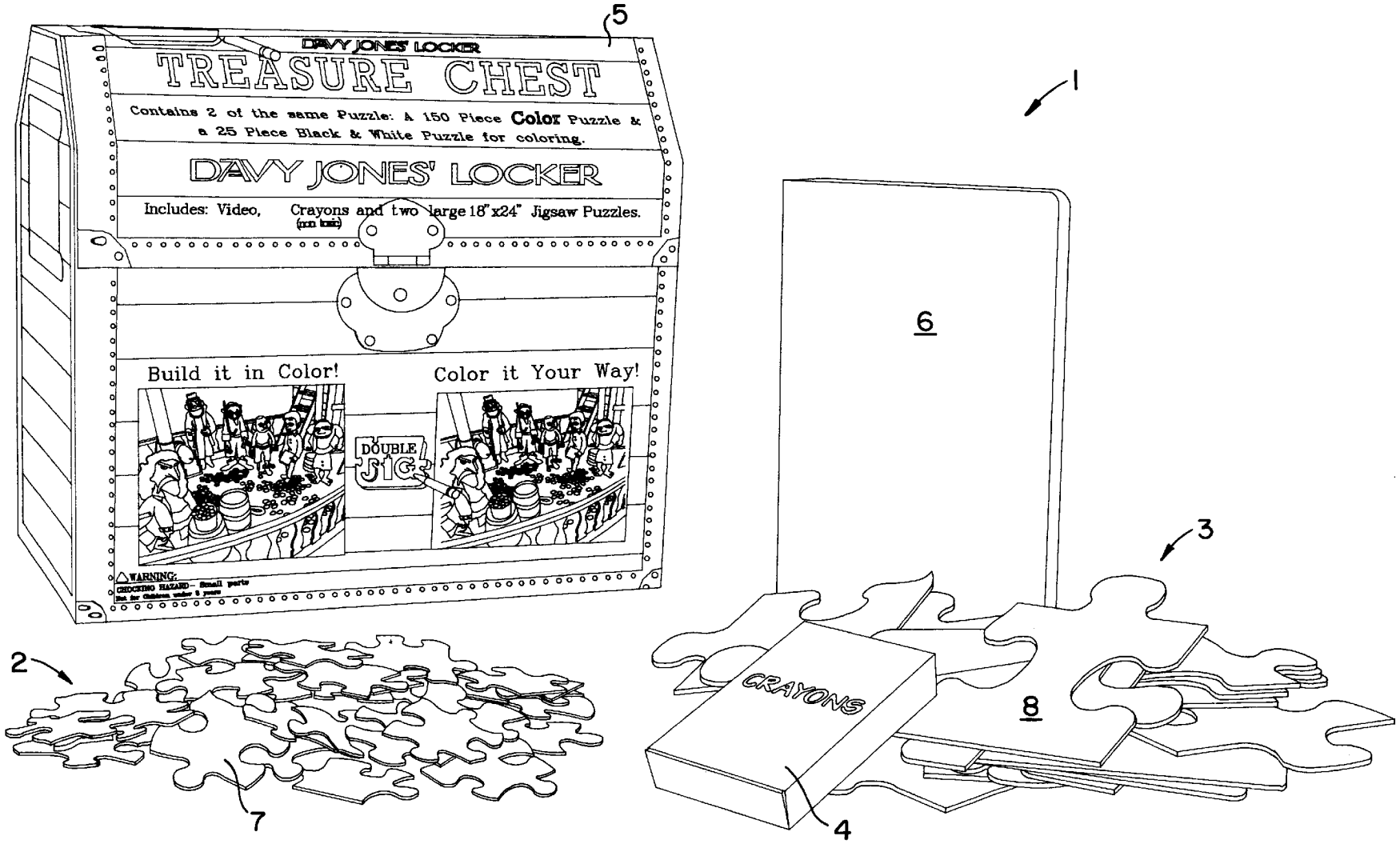
1
2
3
4
5
6
7
8
CRAYONS
DAVY JONES' LOCKER
TREASURE CHEST
Contains 2 of the same Puzzle: A 150 Piece Color Puzzle &
a 25 Piece Black & White Puzzle for coloring.
DAVY JONES' LOCKER
Includes: Video, Crayons and two large 18" x24" Jigsaw Puzzles.
Build it in Color!
DOUBLE
JIG
Color it Your Way!
WARNING:

ENTERTAINMENT KIT

The present Invention is directed to a jigsaw puzzle kit which will challenge and entertain the user, as well as improving his or her manual dexterity.

SUMMARY OF THE INVENTION

The present Invention is an entertainment kit which comprises a colored drawing mounted on a first substrate. The kit further includes a second uncolored jigsaw puzzle which is a line drawing mounted on a second substrate. Each substrate is cut in a jigsaw pattern. The drawing on the second substrate corresponds to the colored drawing, except that only the outlines of the drawing elements are provided. The uncolored puzzle is adapted to be manually colored, using the colored drawing as a guide. In a preferred form of the Invention, the kit also includes coloring instruments such as crayons, colored pencils, and colored pens.

Thus, the user first assembles the colored jigsaw puzzle and, thereafter, assembles the uncolored jigsaw puzzle. Once this has been completed, the latter is colored in manually using the coloring instruments. While the nature of the paper upon which the uncolored drawing is placed is not critical, it has been found most desirable to use a bright white, opaque, uncoated offset paper. It is best if the paper is non-gloss and has a porous finish so as to absorb the coloring agent. The colored puzzle is best placed on an all-purpose lithographic paper, which is coated on one side and uncoated on the other. The latter is mounted on the substrate. The substrates used for both puzzles are preferably 70 to 90 pt. chipboards, but any other suitable substrate may be substituted therefor.

In a particularly preferred form of the Invention, the uncolored puzzle would be such that, after it has been colored, the coloring could be wiped off and the puzzle reused. This can advantageously be accomplished by applying a clear thin transparent plastic film over the black-and-white puzzle picture. This can be done by a heat activated adhesive, preferably at the factory. However, the manner of affixing the plastic film is not critical and any of the usual means can be utilized.

In a refinement of the kit, the uncolored jigsaw puzzle is made up of pieces which are substantially larger and fewer than those of the colored jigsaw puzzle. The former, because of the absence of color, is more difficult to assemble; therefore, by making the pieces larger, assembly is facilitated. Also, the lines of the drawing can be more readily distinguished from the joints of the pieces if the pieces are larger. As a further desirable feature, an audio and/or visual recording, with subject matter relating to the drawings, is included. Thus, the user can be entertained by the recording, challenged by the necessity of assembling both puzzles, and have an opportunity to improve his manual dexterity by coloring in the uncolored drawing. For those less skilled, the colored drawing will act as a guide.

BRIEF DESCRIPTION OF THE DRAWING

The accompanying drawing is a partial schematic view showing the various elements of the kit.

DETAILED DESCRIPTION OF THE INVENTION

Kit 1 comprises colored puzzle 2 and uncolored puzzle 3. Uncolored puzzle 3 bears a line drawing corresponding to the drawing of colored puzzle 2. The kit also includes crayons 4 and video cassette 6. All of the elements are placed in container 5 to form a single unit.

Since the uncolored puzzle is more difficult to assemble than the colored puzzle, in a desirable form of the Invention, colored puzzle 2 has colored puzzle pieces 7 which are substantially smaller than line puzzle pieces 8. This is best accomplished by having the two puzzles the same size, but the uncolored puzzle pieces are substantially larger than those of the colored puzzle. Alternatively, the uncolored puzzle can be made smaller than the colored puzzle. With fewer pieces, uncolored puzzle 3 is rendered easier to assemble. This enables kit 1 to be useful for younger children.

Although only a limited number of specific embodiments of the present Invention have been expressly disclosed, it is, nonetheless, to be broadly construed, and not to be limited except by the character of the claims appended hereto.

What is claimed is:

1. An entertainment kit comprising a colored drawing mounted on a first substrate, said first substrate and said colored drawing thereon constituting a colored jigsaw puzzle, a line drawing mounted on a second substrate, said line drawing and said second substrate constituting an uncolored jigsaw puzzle, said line drawing corresponding to said colored drawing, said uncolored jigsaw puzzle adapted to be colored in manually.

2. The entertainment kit of claim 1 comprising a set of coloring instruments adapted to color said uncolored jigsaw puzzle.

3. The entertainment kit of claim 1 comprising an audio and/or visual recording containing subject matter related to said color drawing and said line drawing.

4. The entertainment kit of claim 2 wherein said color instruments are crayons.

5. The entertainment kit of claim 1 wherein said uncolored jigsaw puzzle has fewer pieces than said colored jigsaw puzzle.

6. The entertainment kit of claim 1 wherein said colored jigsaw puzzle and said uncolored jigsaw puzzle are of substantially the same size, said uncolored jigsaw puzzle having fewer pieces than said colored jigsaw puzzle.

* * * * *